US006332454B1

(12) United States Patent
Itabashi et al.

(10) Patent No.: US 6,332,454 B1
(45) Date of Patent: Dec. 25, 2001

(54) ELECTROMAGNETIC VALVE DRIVING APPARATUS HAVING CURRENT LIMIT SWITCHING FUNCTION

(75) Inventors: Toru Itabashi, Anjo; Atsushi Yamada, Kariya, both of (JP)

(73) Assignee: Denso Corporation (JP)

( * ) Notice: Subject to any disclaimer, the term of this patent is extended or adjusted under 35 U.S.C. 154(b) by 0 days.

(21) Appl. No.: 09/627,428

(22) Filed: Jul. 27, 2000

(30) Foreign Application Priority Data

Aug. 6, 1999 (JP) ..... 11-224029

(51) Int. Cl.[7] ..... F02M 51/00; F02M 37/08
(52) U.S. Cl. ..... 123/490; 123/499; 361/154
(58) Field of Search ..... 123/490, 499; 361/154

(56) References Cited

U.S. PATENT DOCUMENTS

| | | | | |
|---|---|---|---|---|
| 4,180,026 | | 12/1979 | Schulzke et al. . | |
| 4,605,983 | | 8/1986 | Harvey . | |
| 4,680,667 | | 7/1987 | Petrie . | |
| 5,937,828 | * | 8/1999 | Watanabe | 123/490 |
| 5,947,090 | * | 9/1999 | Maeda | 361/154 |
| 5,975,097 | * | 11/1999 | Repplinger et al. | 123/490 |
| 6,123,058 | * | 9/2000 | Endou | 123/490 |
| 6,209,513 | * | 4/2001 | Sakasai et al. | 361/154 |
| 6,283,095 | * | 9/2001 | Krueger | 123/499 |

FOREIGN PATENT DOCUMENTS 8 4576 1/1996 (JP) .

* cited by examiner

*Primary Examiner*—Erick Solis
(74) *Attorney, Agent, or Firm*—Nixon & Vanderhye PC

(57) ABSTRACT

A driving apparatus for an electromagnetic valve which supplies fuel to an engine comprises a conduction control circuit and a current-limit-value setting circuit. The conduction control circuit turns on and off an FET so that a conduction current flowing through a coil of the electromagnetic valve has a magnitude equal to a predetermined current limit value while a microcomputer is outputting a driving signal to the conduction control circuit. The predetermined current limit value used in the conduction control circuit is set at a first current limit value during a predetermined period starting at a point of time the microcomputer outputs the driving signal. When the predetermined period has lapsed, the predetermined current limit value is switched from the first current limit value to a second current limit value which is smaller than the first current limit value. In addition, when the microcomputer detects a start state of the engine or a low level state of a battery voltage, the second current limit value is raised to the first current limit value to thereby improve the starting characteristics of the engine.

21 Claims, 12 Drawing Sheets

ELECTROMAGNETIC VALVE DRIVING APPARATUS HAVING CURRENT LIMIT SWITCHING FUNCTION

CROSS REFERENCE TO RELATED APPLICATION

This application relates to and incorporates herein by reference Japanese Patent Application No. 11-224029 filed on Aug. 6, 1999.

BACKGROUND OF THE INVENTION

The present invention relates to an apparatus for driving an electromagnetic valve used for supplying fuel to an engine of a vehicle.

A conventional electromagnetic valve driving apparatus of this type is disclosed in U.S. Pat. No. 4,605,983 (JP-B2-4-42805). When this apparatus is applied to a high-pressure fuel pump, a conduction current flowing through a coil employed in an electromagnetic valve is driven to reach a predetermined magnitude Ip before a predetermined period of time lapses after the start of the valve driving so that the movable body of the valve may be actuated quickly. Thereafter, the conduction current is reduced to a small holding magnitude Ih (<Ip) which is large enough only for holding the movable body of the valve at the current position. As a result, a good driving response of the electromagnetic valve or the operating response of the valve body can be attained by merely supplying a reduced conduction current or a reduced driving current.

In a state where the engine is being started or various electric loads are turned on under a low engine speed condition such as an idling, a battery voltage drops due to the operation of a starter motor or the electric loads. In addition, the conduction-holding period becomes longer at a very low engine speed. It is therefore likely that the battery voltage substantially decreases even during the conduction-holding period. As a result, according to the above apparatus, the amount of fuel supplied to the engine during the start time of the engine is not sufficient and the start characteristic of the engine is lessened.

U.S. Pat. No. 4,605,983 also discloses to lengthen a predetermined period of limiting the conduction current to a peak current as the voltage of the battery decreases. However, this is not useful for solving the problem of a drop in battery voltage, which occurs in the conduction-holding period following the predetermined period.

The above problem occurs irrespective of the type of the electromagnetic valve, that is, a normally closed-type or a normally open-type. In addition, the above problem is also encountered in the case of an electromagnetic valve employed as a fuel injector (a fuel injection valve) for supplying fuel to the engine. In this case, if the duration of the operating time of the electromagnetic valve becomes too short, the amount of fuel supplied to the engine is not sufficient by a quantity determined by a decrease in operating-time duration.

In another conventional apparatus disclosed in JP-A-8-4576, a current supplied to a fuel injection valve is set at a value higher than that of the ordinary operation only at the first injection at the time the engine is started. However, since it is still impossible to improve the start characteristic of the engine accompanying a drop in battery voltage, because the voltage drop is not predictable. In addition, in order to supply a current with a magnitude greater than that of a normal condition through the coil at a low battery voltage, a voltage raising circuit must be provided.

SUMMARY OF THE INVENTION

It is thus an object of the present invention to provide an electromagnetic valve driving apparatus capable of ensuring a good valve driving characteristic for an engine.

According to the present invention, a driving apparatus for an electromagnetic valve which supplies fuel to an engine comprises a conduction control circuit and a current-limit-value setting circuit. The conduction control circuit turns on and off a switching device so that a conduction current flowing through a coil of the electromagnetic valve has a magnitude equal to a predetermined current limit value. The predetermined current limit value used in the conduction control circuit is initially set to a first current limit value, which is high enough to move a valve body, during a predetermined period. When the predetermined period has lapsed, the predetermined current limit value is switched from the first current limit value to a second current limit value, which is smaller than the first current limit value thereby to maintain a position of the movable body. In addition, when the microcomputer detects a start state of the engine or a low level state of a battery voltage, the second current limit value is raised to a third current limit value higher than the second current limit value so that the movable body may be driven with the higher current to thereby shorten a period in which the electromagnetic valve becomes inoperative.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF THE PREFERRED EMBODIMENT

Figure 1:
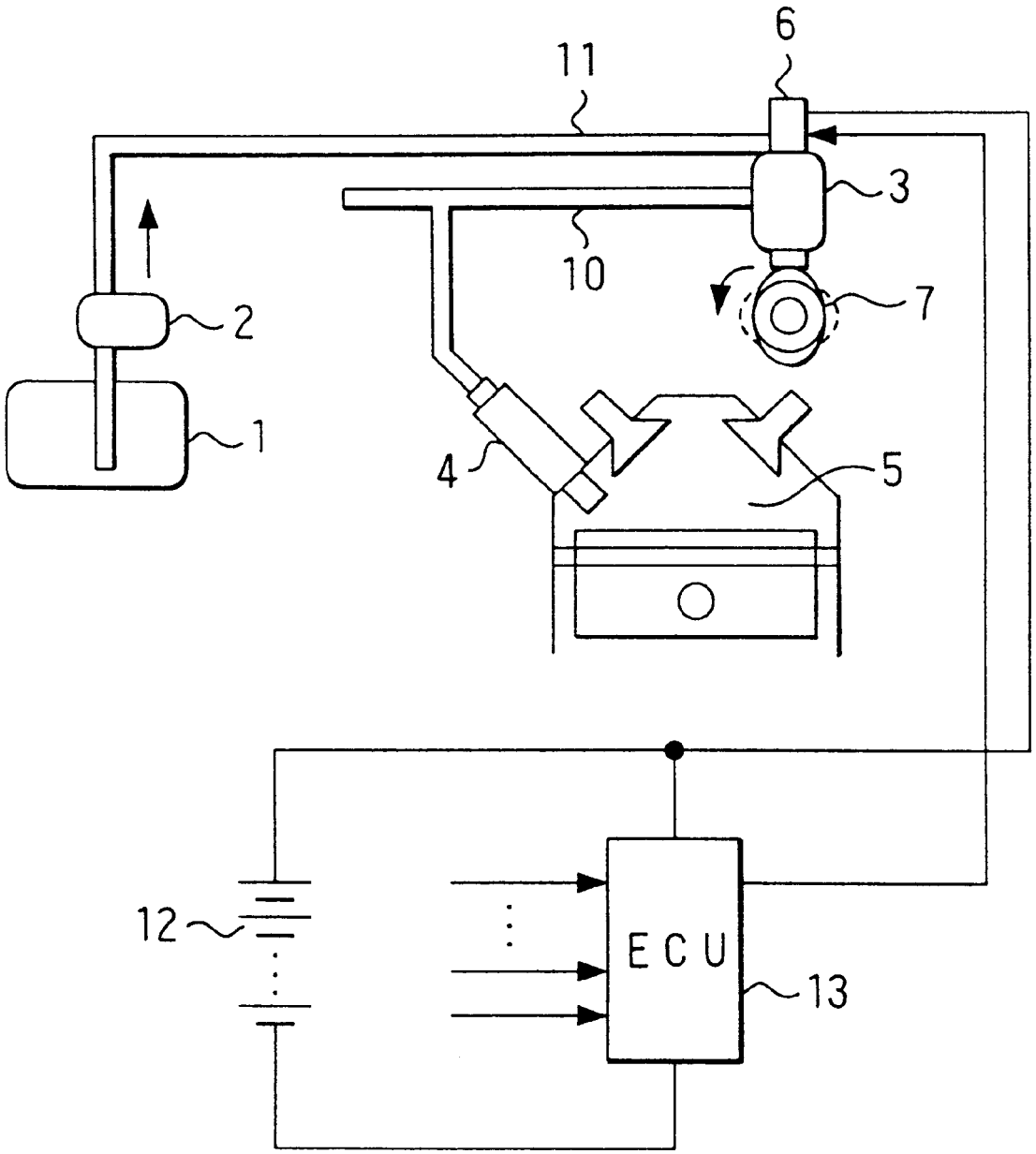
FIG. 1 is a schematic diagram showing a control system of a direct-injection type gasoline engine to which the present invention is applied.

The present invention will be described in further detail with reference to embodiments that are directed to a control system of a direct-injection type gasoline engine. The same or similar reference numerals designate the same or similar parts throughout the embodiments.

As shown in FIG. 1, fuel is supplied from a fuel tank 1 through a low-pressure pump 2 is supplied to a high-pressure fuel pump 3 which raises the pressure of the fuel to a predetermined value before supplying the fuel to an injector (electromagnetic fuel injection valve) 4. The injector 4 then directly injects the fuel into a fuel chamber 5 of the engine.

Figure 2:
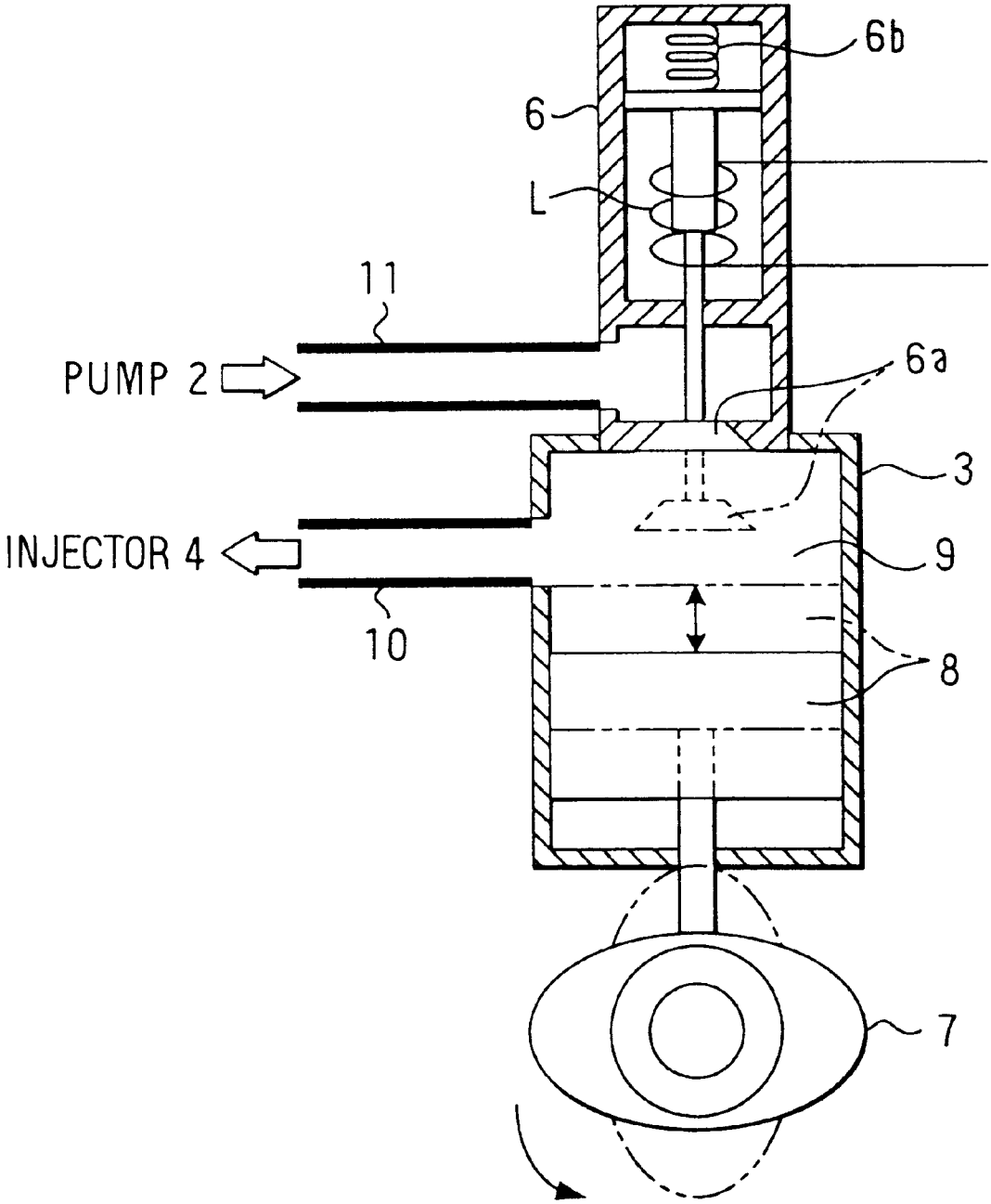
FIG. 2 is a schematic sectional view showing a high-pressure fuel pump used in the system shown in FIG. 1.

As shown in FIG. 2, the high-pressure fuel pump 3 is provided with an electromagnetic valve 6, a piston 8 moving reciprocally in accordance with the rotation of a camshaft 7 of the engine, and a fuel chamber 9 which is linked to the injector 4 by a fuel supply path 10 and has its volume increasing and decreasing with the reciprocal movement of the piston 8.

It should be noted that, the electromagnetic valve 6 is a valve of a normally-open type. That is, in the electromagnetic valve 6, when no current is supplied to a coil L, a movable valve body 6*a* is biased downward in the figure by the biasing force of a return spring 6*b* to an opened-valve position which links a fuel supply path 11 from the low-pressure pump 2 to the fuel chamber 9. When a current is supplied to the coil L, on the other hand, the valve body 6*a* is attracted upward, resisting the biasing force of the return spring 6*b* to a closed-valve position which blocks the fuel supply path 11 from the low-pressure pump 2 to the fuel chamber 9.

When the piston 8 moves downward to supply fuel from the low-pressure pump 2 to the fuel chamber 9 in the high-pressure fuel pump 3, the coil L of the electromagnetic valve 6 is put in a deenergized state to move the valve body 6*a* to the open-valve position, opening the electromagnetic valve 6. When the piston 8 moves upward to raise the pressure in the fuel chamber 9 for discharging the fuel in the fuel chamber 9 to the injector 4, on the other hand, the current flows through the coil L of the electromagnetic valve 6 to move the valve body 6*a* to the closed-valve position, closing the electromagnetic valve 6.

The conduction timing and the conduction duration of the coil L employed in the electromagnetic valve 6 are controlled by an electronic control unit (ECU) 13 shown in FIG. 1, that is used as an electromagnetic valve driving apparatus, synchronously with the rotations of the camshaft 7 and the crankshaft of the engine. The driving apparatus receives electric power from a battery 12 mounted on a vehicle.

First Embodiment

Figure 3:
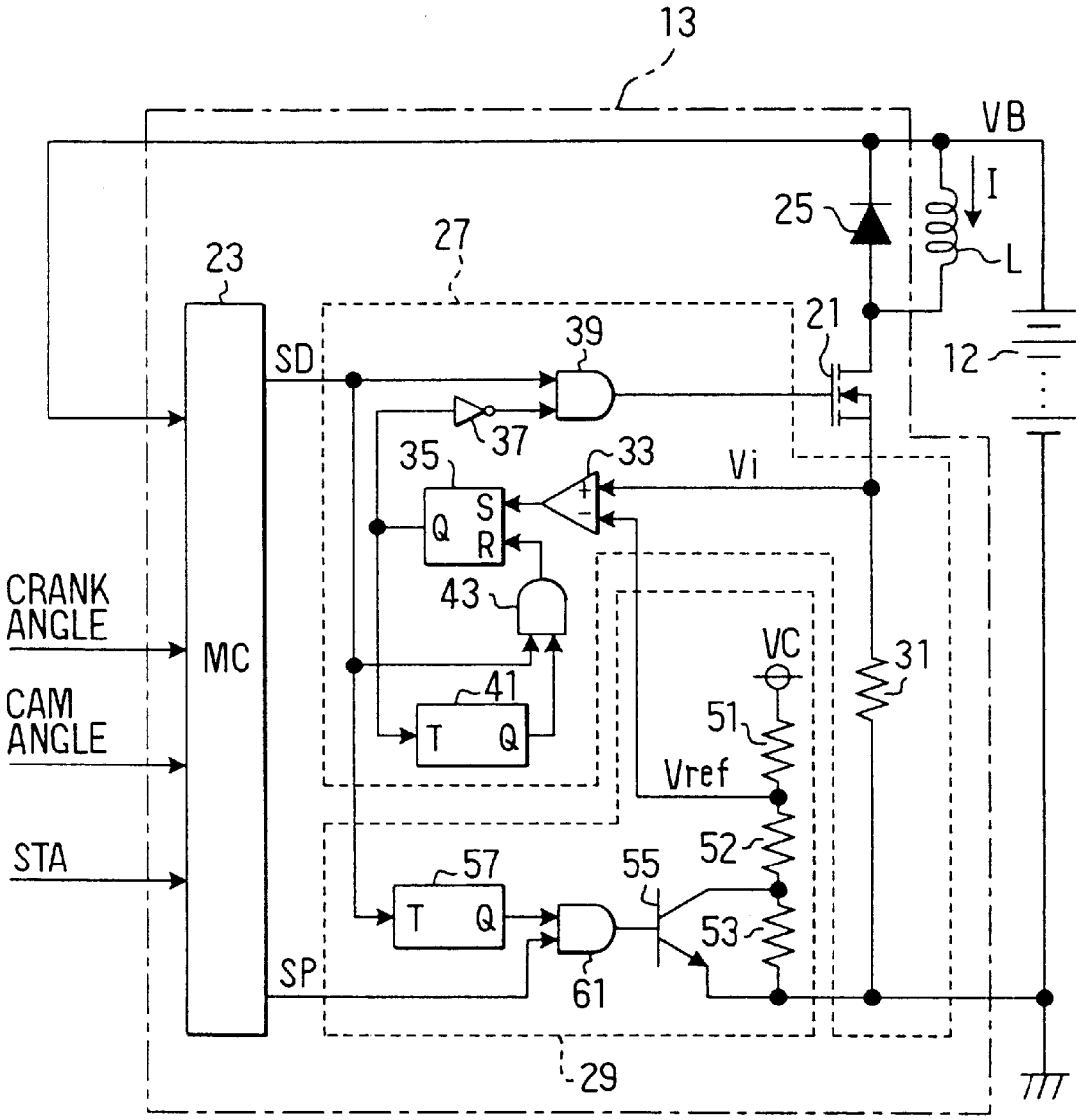
FIG. 3 is a circuit diagram showing an electronic control unit used as an electromagnetic valve driving apparatus for the system shown in FIG. 1 according to a first embodiment of the present invention.

The electronic control unit 13 according to a first embodiment includes, as shown in FIG. 3, an N-channel MOSFET 21 connected in series to the coil L on a current path for supplying a conduction current I from the battery 12 to the coil L employed in the electromagnetic valve 6. The N-channel MOSFET 21 serves as a switching device which can be turned on for supplying the conduction current I to the coil L to drive the electromagnetic valve 6. The conduction current I closes the normally-opened electromagnetic valve 6.

The electronic control unit 13 also has a microcomputer (MC) 23 for outputting a high level driving signal SD for turning on the N-channel MOSFET 21. The high level driving signal SD is output on the basis of a crankshaft rotation signal generated by a crankshaft rotation sensor of the engine to represent the rotation angle of the crankshaft (crank angle) and a camshaft rotation signal generated by a camshaft rotation sensor to represent the rotation angle of the camshaft (cam angle).

It should be noted that this embodiment adopts the low-side switching system wherein one end of the coil L is connected to the plus-side terminal of the battery 12 and the other end of the coil L is connected to the drain of the N-channel MOSFET 21. A diode 25 is connected between the terminals of the coil L. When the N-channel MOSFET 21 is turned off, energy accumulated in the coil L is discharged through the diode 25.

In addition, the electronic control unit 13 also includes a conduction control circuit 27 for turning on the N-channel MOSFET 21 so that the conduction current I flowing through the coil L reaches a predetermined current limit value while the microcomputer 23 is outputting the high level driving signal SD. The electronic control unit 13 further has a current-limit-value setting circuit 29 for setting a first current limit value Ip and a second current limit value Ih. Referred to as a limit corresponding to a peak current, the first current limit value Ip is a current magnitude to be reached by the conduction current I controlled by the conduction control circuit 27 during a predetermined period T2 starting from a point of time the high level driving signal SD is output by the microcomputer 23. Referred to as a limit corresponding to a holding current, the second current limit value Ih is a current magnitude at which the conduction current I controlled by the conduction control circuit 27 is to be set after the period T2 has lapsed. The second current limit value Ih is smaller than the first current limit value Ip.

The conduction control circuit 27 comprises a current detection resistor 31, a comparator 33, a set-reset (SR) latch 35, an inverter 37, an AND gate 39, a timer 41 and an AND gate 43. The current detection resistor 31 is connected between the source of the N-channel MOSFET 21 and the ground or the minus terminal of the battery 12. A voltage Vi generated between the ends of the current detection resistor 31 is proportional to the conduction current I flowing through the coil L. The voltage vi is supplied to a non-inverting (+) input terminal of the comparator 33. The output of the comparator 33 is connected to a set terminal S of the SR latch 35. The output of the SR latch 35 appearing at an output terminal Q thereof is inverted by the inverter 37. The output of the inverter 37 and the high level driving signal SD generated by the microcomputer 23 are supplied to the AND gate 39 for outputting a logical-product signal to the gate of the N-channel MOSFET 21. The output terminal Q of the SR latch 35 is also connected to an input terminal T of the timer 41.

When the SR latch 35 outputs a high level signal, the timer 41 drives its internal counter to start a counting operation. As the counting operation corresponding to a period T1 set in advance is completed, a signal appearing at an output terminal Q of the timer 41 is inverted to a high level. When the SR latch 35 outputs a low level signal, on the other hand, the internal counter of the timer 41 is reset and the signal appearing at the output terminal Q of the timer 41 is inverted to a low level. The signal appearing at the output terminal Q of the timer 41 and the high level driving signal SD generated by the microcomputer 23 are supplied to the AND gate 43 for outputting a signal to a reset terminal R of the SR latch 35.

On the other hand, the current-limit-value setting circuit 29 comprises three resistors 51, 52 and 53, an NPN transistor 55, a timer 57 and an AND gate 61. The resistors 51, 52 and 53 are connected in series between a regulated power-supply voltage Vc and the ground. The power-supply voltage Vc is generated in the electronic control unit 13 from the voltage VB of the battery 12. The resistor 51 is connected to the voltage Vc side, the resistor 53 is connected to the ground side and the resistor 52 is connected between the resistors 51 and 53. A point of connection between the resistors 52 and 53 is connected to the collector of the NPN transistor 55. The other end of the resistor 53 is connected to the emitter of the NPN transistor 55 and the ground. A reference voltage Vref appearing at a point of connection between the resistors 51 and 52 can be changed by the NPN transistor 55.

The high level driving signal SD generated by the microcomputer 23 is supplied to an input terminal T of the timer 57. When the driving signal SD is raised from a low level to a high level, an internal counter in the timer 57 is reset and a low level signal is output from an output terminal Q of the timer 57 to the NPN transistor 55 through the AND gate 61. At the same time, a counting operation is started. As the counting operation corresponding to the period T2 set in advance is completed, the signal appearing at the output terminal Q of the timer 57 is inverted to a high level for turning on the NPN transistor 55 as long as a signal SP applied to the AND gate 61 is at the high level. The reference voltage Vref appearing at the point of connection between two of the transistors 51, 52 and 53, that is, the resistors 51 and 52, is supplied to an inverting (−) input terminal of the comparator 33 for comparing the reference voltage Vref with the voltage Vi generated by the current detection resistor 31.

In this unit 13, with the NPN transistor 55 of the current-limit-value setting circuit 29 turned off, the reference voltage Vref supplied to the inverting input terminal of the comparator 33 represents the first current limit value Ip or the magnitude of a peak current. It is assumed that the resistances of the resistors 51 to 53 are R51 to R53 respectively. In this case, the reference voltage Vref(Ip) representing the first current limit value Ip is given by the following equation:

$$Vref(Ip)=VC\times(R52+R53)/(R51+R52+R53)$$

The first current limit value Ip is a quotient determined as a result of dividing the reference voltage Vref(Ip) by the resistance of the current detection resistor 31. The first current limit value Ip is set at such a value that, for a normal battery voltage VB, during the predetermined period T2 starting from a point of time the N-channel MOSFET 21 is turned on, the conduction current I flowing through the coil L of the electromagnetic valve 6 once exceeds the first current limit value Ip, causing the operation of the valve body 6a of the electromagnetic valve 6 to be completed with a high degree of reliability. In the case of this embodiment, the operation of the valve body 6*a* is an operation to close the electromagnetic valve 6.

In the electronic control unit 13, when the NPN transistor 55 employed in the current-limit-value setting circuit 29 is turned on, one of the resistors 51 to 53, namely, the resistor 53, is short-circuited. In this state, the reference voltage Vref supplied to the inverting input terminal of the comparator 33 is a voltage Vref(Ih) corresponding to the second current limit value Ih, that is, the magnitude of a holding current. It should be noted that the reference voltage Vref(Ih) is given as follows:

$$Vref(Ih)=VC\times R52/(R51+R52)$$

The second current limit value Ih is a quotient determined as a result of dividing the reference voltage Vref(Ih) by the resistance of the current detection resistor 31. The second current limit value Ih is set at a minimum value required for sustaining the operation of the electromagnetic valve 6 in a conductive state, that is, the operation to keep the valve closed in the case of this embodiment. The second current limit value Ih is smaller than the first current limit value Ip.

Figure 5:
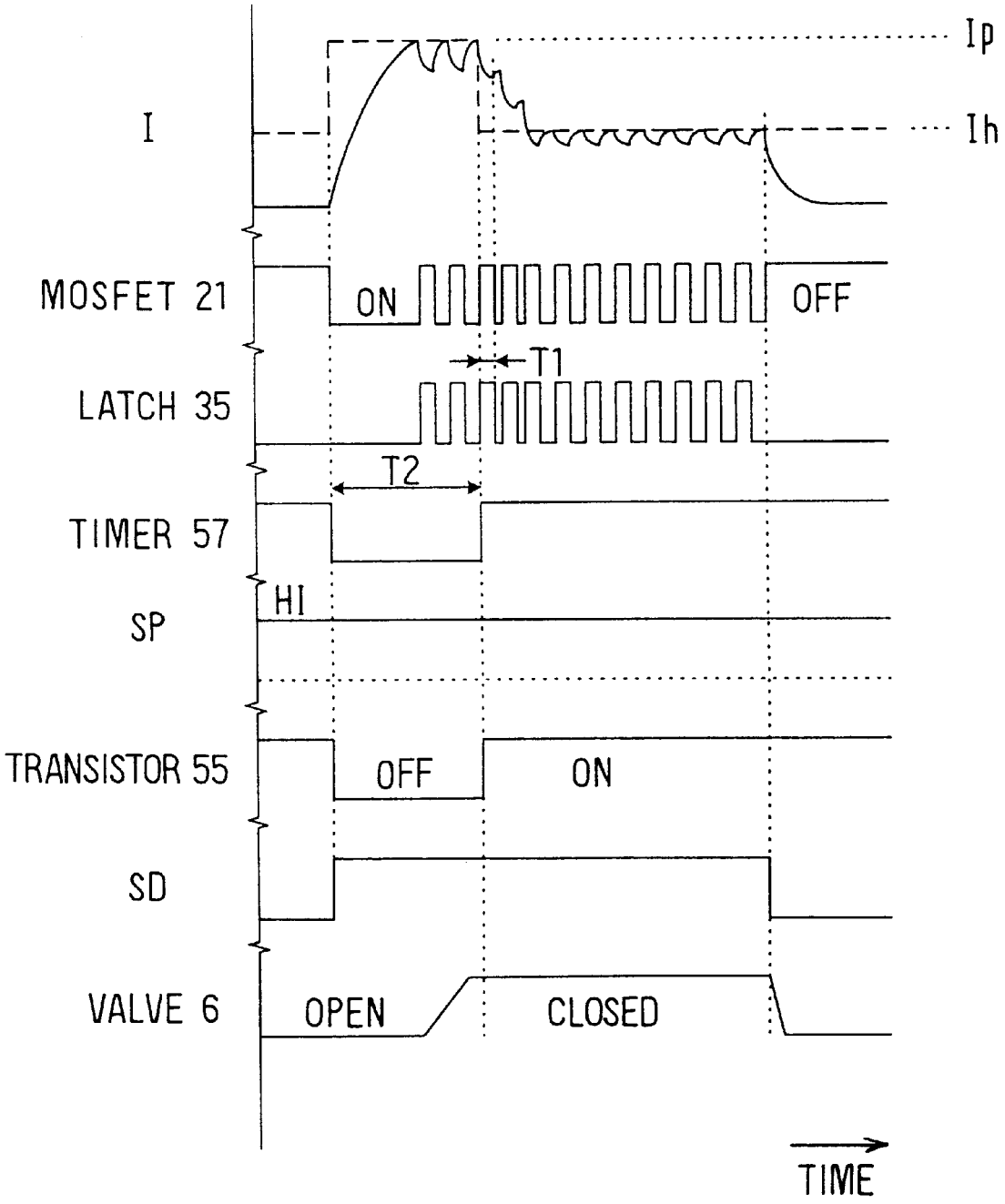
FIG. 5 shows a timing diagram showing operations carried out by the electronic control unit of the first embodiment at a normal time.

In the electronic control unit 13, the comparator 33 employed in the conduction control circuit 27 compares the conduction current I flowing through the coil L with the reference voltage Vref which can be the first current limit value Ip or the second current limit value Ih. Each time the conduction current I exceeds the reference voltage Vref, the N-channel MOSFET 21 is temporarily turned off for a period T1 to cut off the conduction current I as shown in FIG. 5. The timer 41 employed in the conduction control circuit 27 is used for detecting the lapse of the period T1. On the other hand, the timer 57 employed in the current-limit-value setting circuit 29 is used for detecting the lapse of the period T2 as measured from a point of time the high level driving signal SD is output by the microcomputer 23. As the period T2 lapses, the limit value of the conduction current I controlled by the conduction control circuit 27 is changed from the first current limit value Ip to the second current limit value Ih as shown in FIG. 5.

It is to be noted that the AND gate 61 is provided between the output terminal Q of the timer 57 employed in the current-limit-value setting circuit 29 and the base of the NPN transistor 55 with the output terminal of the AND gate 61 connected to the base of the NPN transistor 55. One of the input terminals of the AND gate 61 is connected to the output terminal Q of the timer 57 while the other input terminal is used for receiving the current-limit control signal SP output by the microcomputer 23.

Figure 4:
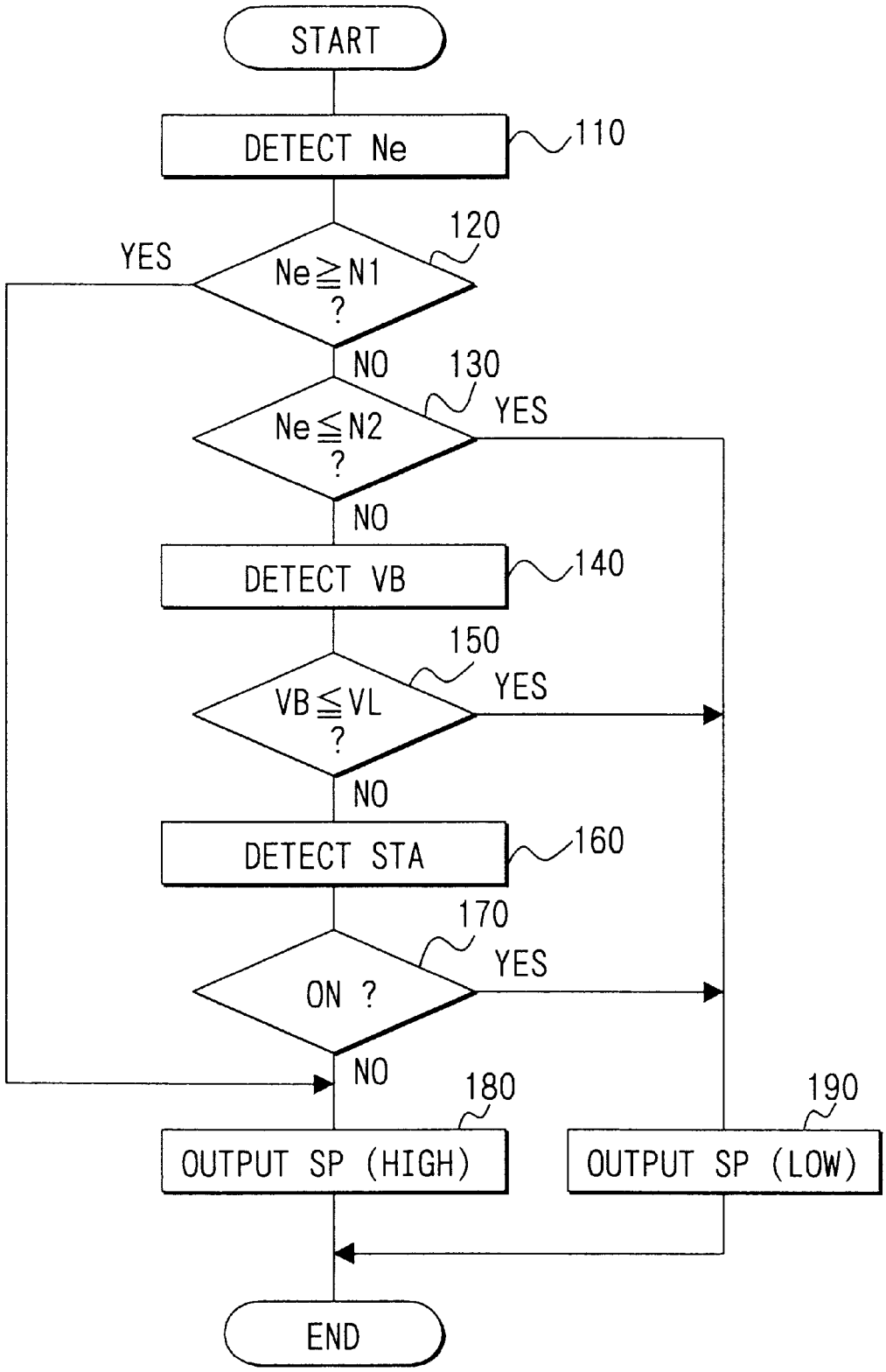
FIG. 4 is a flow diagram showing processing carried out by a microcomputer employed in the first embodiment.

The microcomputer 23 is programmed to repeatedly carry out processing shown in FIG. 4 at predetermined intervals.

The processing begins with step 110 at which the microcomputer 23 detects the engine speed Ne. It should be noted that the engine speed Ne may be calculated periodically from the crankshaft rotation signals generated by the crankshaft rotation sensor.

Then, at the next step 120, the microcomputer 23 checks whether the engine speed Ne detected at step 110 is at least equal to a first predetermined value N1 which is higher than an idling rotational speed of typically 700 rpm. In this embodiment, the first predetermined value N1 is set at 3,000 rpm. If the engine speed Ne is determined to be at least equal to the first predetermined value N1, the processing goes on to step 180. At step 180, the current-limit control signal SP supplied to the AND gate 61 is set to the high level and the processing is finished. It should be noted that the current-limit control signal SP is sustained at this high level till the level is switched at step 190.

If the engine speed Ne is determined at step 120 to be lower than the first predetermined value N1, on the other hand, the processing goes on to step 130 at which the microcomputer 23 checks whether the engine speed Ne detected at step 110 does not exceed a second predetermined value N2 which is lower than the idling rotational speed. The speed N2 is a rotational speed at which the engine can be considered to be in a state of being started. In this embodiment, the second predetermined value N2 is set at 200 rpm.

If the engine speed Ne is determined to be higher than the second predetermined value N2 at step 130, the processing goes on to step 140 at which the battery voltage VB is read in. Then, at the next step 150, the microcomputer 23 checks whether the battery voltage VB detected at step 140 is not higher than a predetermined level-drop criterion voltage VL which is close to a minimum rated voltage of the battery 12. In this embodiment, the level-drop criterion voltage VL is set at 7 V.

If the battery voltage VB is determined to be higher than the predetermined level-drop criterion voltage VL, the processing goes on to step 160 at which the level of a starter switch signal SW is detected. The starter switch signal SW set to a high level indicates that a starter switch for a starter motor has been turned on to start the engine. At the next step 170, the microcomputer 23 checks whether the starter switch has been turned on from the level of the starter switch signal SW.

If the starter switch condition is determined at step 170 to have not been turned on, the processing goes on to step 180 at which the current-limit control signal SP supplied to the AND gate 61 is set to a high level and the processing is finished.

If the engine speed Ne is determined to be equal to or lower than the second predetermined value N2 at step 130, or if the starter switch is determined at step 170 to have been turned on, on the other hand, the engine is determined to be in a state of being started. In this case, the processing goes on to step 190. In addition, if the battery voltage VB is determined to be equal to or lower than the predetermined level-drop criterion voltage VL at step 150, the battery voltage VB is determined to be in a low level state. In this case, the processing also goes on to step 190.

At step 190, the current-limit control signal SP supplied to the AND gate 61 is set to a low level and the processing is finished. It should be noted that the current-limit control signal SP is sustained at this low level till the level is switched at step 180.

As described above, if the microcomputer 23 in the electronic control unit 13 implemented by the first embodiment determines that the engine speed Ne is at least equal to the first predetermined value N1 of 3,000 rpm (YES at step 120), the current-limit control signal SP supplied to the AND gate 61 is set by the microcomputer 23 at the high level at step 180. The current-limit control signal SP is also set to the high level at step 180 if the three determination results at steps 130, 150 and 170 are all NO or, to be more specific, if the engine speed Ne is determined to be higher than the second predetermined value N2 of 200 rpm at step 130, if the battery voltage VB is determined to be higher than the predetermined level-drop criterion voltage VL at step 150 and if the starter switch is determined at step 170 to have not been turned on.

If the microcomputer 23 sets the current-limit control signal SP supplied to the AND gate 61 at the high level, the output of the timer 57 is passed on through the AND gate 61 to the base of the NPN transistor 55 as it is shown in FIG. 5. In this instance, the electronic control unit 13 operates as shown in FIG. 5.

It is assumed that the current-limit-value setting circuit 29 outputs the reference voltage Vref to the inverting input terminal of the comparator 33. The reference voltage Vref can be the first current limit value Ip or the second current limit value Ih.

In the conduction control circuit 27, when the microcomputer 23 outputs the high level driving signal SD, the output of the AND gate 39 is inverted to a high level since the output of the inverter 37 is set to a high level at this point of time. The high level signal output by the AND gate 39 is supplied to the gate of the N-channel MOSFET 21, turning on the N-channel MOSFET 21. As a result, the conduction current I starts flowing through the coil L in the electromagnetic valve 6.

The comparator 33 compares the voltage Vi generated by the current detection resistor 31 with the reference voltage Vref representing the limit of the conduction current I. As a result of the comparison, the comparator 33 sustains its output at the zero level till the conduction current I exceeds the current limit value, that is, till the voltage Vi exceeds the reference voltage Vref. In this state, the flow of the conduction current I through the coil L is sustained. It should be noted that this state is represented in the timing diagram of FIG. 5 by a period starting at a change of the driving signal SD to a high level and ending at a point of time at which the conduction current I flowing through the coil L reaches the first current limit value Ip for the first time.

As the conduction current I flowing through the coil L exceeds the current limit value later on, the signal output by the comparator 33 is inverted to the high level and supplied to the set terminal S of the SR latch 35. As a result, the high level signal appears at the output terminal Q of the SR latch 35. The high level signal output by the SR latch 35 is inverted by the inverter 37 to the low level signal which is supplied to one of the input terminals of the AND gate 39. Thus, the signal output by the AND gate 39 is inverted to the low level signal which turns off the N-channel MOSFET 21, discontinuing the flow of the conduction current I through the coil L. It should be noted that this state is represented by the high levels of the output of the SR latch 35 and the drain voltage of the N-channel MOSFET 21 in the timing diagram of FIG. 5.

The high level signal output by the SR latch 35 is also supplied to the input terminal T of the timer 41. Thus, the timer 41 drives its internal counter to start the counting operation at a point of time the output of the SR latch 35 is set to a high level at a point of time the N-channel MOSFET 21 is turned off. As the counting operation corresponding to the period T1 is completed, the timer 41 outputs the high level signal to one of the input terminals of the AND gate 43.

Since the high level driving signal SD supplied to the other input terminal of the AND gate 43 is set to the high level while the electromagnetic valve 6 is being driven, the AND gate 43 outputs the high level signal to the reset terminal R of the SR latch 35 when the timer 41 outputs the high level signal to one of the input terminals of the AND gate 43. As a result, the SR latch 35 is reset, inverting its output to the low level signal. The low level signal output by the SR latch 35 is inverted by the inverter 37 to the high level signal supplied to one of the input terminals of the AND gate 39. Thus, the signal output by the AND gate 39 is inverted back to the high level signal which again turns on the N-channel MOSFET 21, resuming the flow of the conduction current I through the coil L.

Then, after the flow of the conduction current I through the coil L is resumed, the comparator 33 checks whether the conduction current I flowing through the coil L exceeds the current limit value, that is, whether the voltage Vi generated at the current detection resistor 31 exceeds the reference voltage Vref. As the conduction current I flowing through the coil L exceeds the current limit value, the signal output by the comparator 33 is set to the high level, turning off the N-channel MOSFET 21. As soon as the lapse of the turned-off time of the N-channel MOSFET 21 reaches the set period T1 of the timer 41, the N-channel MOSFET 21 is turned on again. The operations to turn on and off the N-channel MOSFET 21 as described above are carried out repeatedly. By repeating the operations, the conduction current I flowing through the coil L is limited by the current limit value and sustained at a magnitude close to the current limit value.

When the microcomputer 23 sets the high level driving signal SD to the low level, the signal output by the AND gate 39 is forcibly reset to the low level. As a result, the N-channel MOSFET 21 is turned off without regard to the magnitude of the conduction current I flowing through the coil L.

By carrying out the operations described above, the conduction control circuit 27 controls the conduction of the N-channel MOSFET 21 so that the conduction current I flowing through the coil L is limited by the current limit value and sustained at a magnitude close to the current limit value as long as the microcomputer 23 is outputting the high level driving signal SD.

In the mean time, in the current-limit-value setting circuit 29, when the microcomputer 23 outputs the high level driving signal SD, the timer 57 resets the internal counter thereof, outputting the low level signal to the base of the NPN transistor 55. At the same time, the internal counter starts the counting operation.

Thus, the NPN transistor 55 is turned off. In this state, the reference voltage Vref supplied to the non-inverting input terminal of the comparator 33 is the reference voltage Vref(Ip) corresponding to the first current limit value Ip. That is, the current limit value for the conduction control circuit 27 is set at the first current limit value Ip. As the predetermined period T2 lapses since a point of time the microcomputer 23 outputs the high level driving signal SD, the signal output by the timer 57 is inverted.

As a result, the NPN transistor 55 is again turned on. In this state, the reference voltage Vref supplied to the non-inverting input terminal of the comparator 33 is the Vref(Ih) corresponding to the second current limit value Ih as described earlier. That is, the current limit value for the conduction control circuit 27 is set at the second current limit value Ih which is smaller than the first current limit value Ip.

By carrying out the operations described above, the current-limit-value setting circuit 29 sets the current limit value for the conduction control circuit 27 at the first current limit value Ip till the predetermined period T2 lapses since a point of time the microcomputer 23 outputs the high level driving signal SD. After the predetermined period T2 has lapsed since a point of time the microcomputer 23 outputs the high level driving signal SD, the current-limit-value setting circuit 29 changes the current limit value for the conduction control circuit 27 to the second current limit value Ih smaller than the first current limit value Ip till the microcomputer 23 stops outputting the high level driving signal SD.

As described above, the electronic control unit 13 intermittently turns on the N-channel MOSFET 21 so that the conduction current I flowing through the coil L is maintained at the first current limit value Ip, driving the electromagnetic valve 6 into the opened-valve state and the closed-valve state during the predetermined period T2 starting from a point of time the microcomputer 23 outputs the high level driving signal SD as shown in FIG. 5. After the predetermined period T2 has lapsed since a point of time the microcomputer 23 outputs the high level driving signal SD, the electronic control unit 13 intermittently turns on the N-channel MOSFET 21 so that the conduction current I flowing through the coil L is maintained at the second current limit value Ih smaller than the first current limit value Ip, driving the electromagnetic valve 6 in a closed-valve state till the microcomputer 23 stops outputting the high level driving signal SD. As a result of such conduction control, a good driving response of the electromagnetic valve 6 can be obtained by a reduced conduction current and, hence, at low power consumption.

As opposed to the above operation shown in FIG. 5, if the microcomputer 23 determines that the engine speed Ne is determined to be lower than the first predetermined value N1 of 3,000 rpm (NO at step 120), the current-limit control signal SP supplied to the AND gate 61 is set by the microcomputer 23 to the low level at step 190. The current-limit control signal SP is also set to the low level at step 190 if at least one of the three determination results at steps 130, 150 and 170 is YES or to be more specific, if the engine speed Ne is determined to be equal to or lower than the second predetermined value N2 of 200 rpm at step 130, if the battery voltage VB is determined to be equal to or lower than the predetermined drop criterion voltage VL at step 150 and if the starter switch is determined at step 170 to have been turned on.

Figure 6:
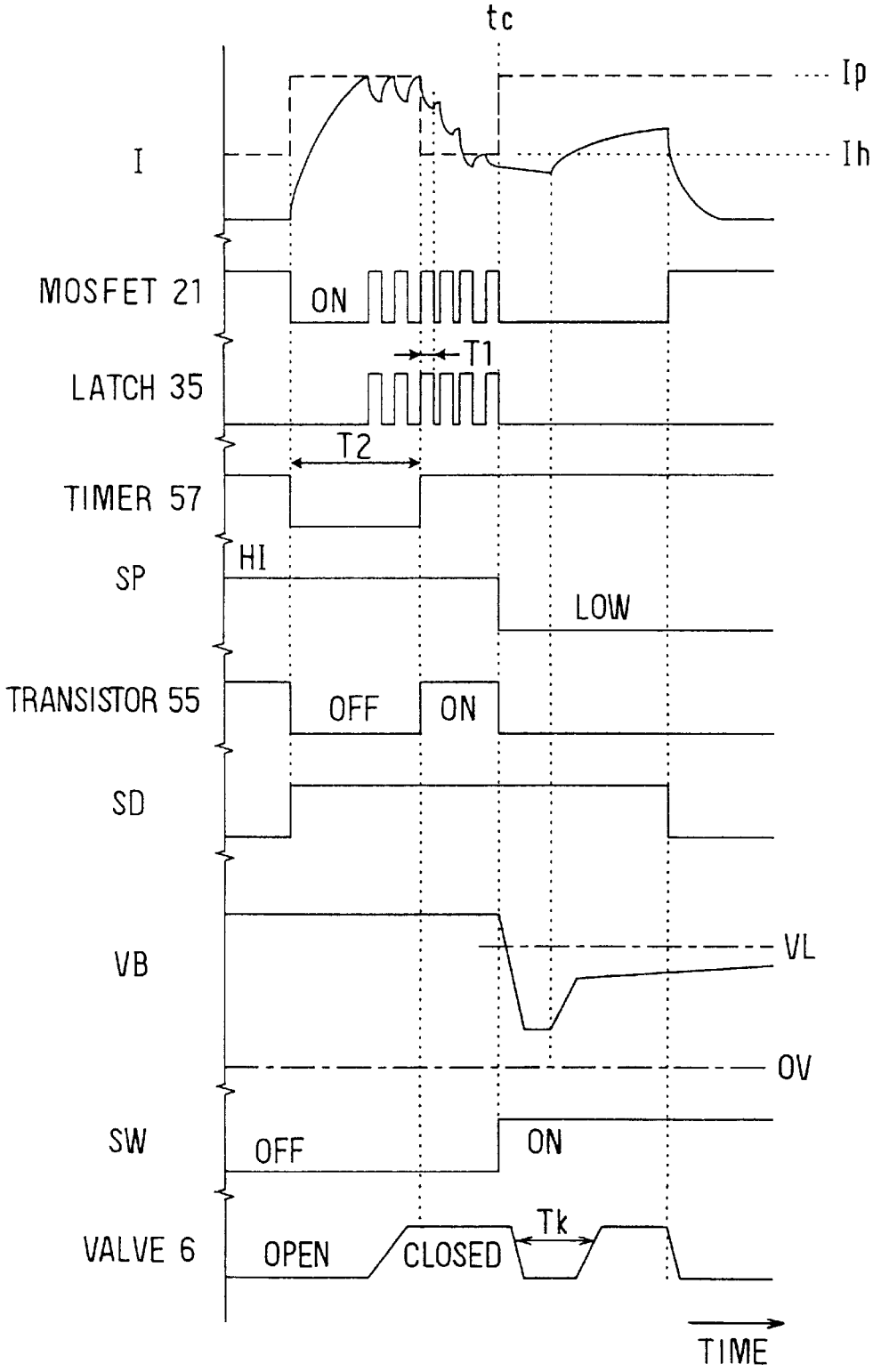
FIG. 6 is a timing diagram showing operations carried out by the electronic control unit of the first embodiment at an engine restart time.

While the microcomputer 23 is supplying the low level current-limit control signal SP to the AND gate 61 starting from a time tc shown in FIG. 6, the low level signal is applied to the base of the NPN transistor 55 without regard to the output of the timer 57. Thus, the NPN transistor 55 is turned off. As a result, the reference voltage Vref supplied to the comparator 33 is fixed at the reference voltage Vref(Ip) corresponding to the first current limit value Ip. That is, the current-limit-value setting circuit 29 sets the current limit value of the conduction control circuit 27 at the first current limit value Ip, that is, the second current limit value Ih that should be set by the current-limit-value setting circuit 29 is changed to the first current limit value Ip which is larger than the second current limit value Ih.

In FIG. 6, it is assumed that the starter motor is driven again from time tc immediately after the initial failure in starting the engine, and hence the conduction current I is supplied to the coil L even during the starter switch singal is at the low level. Thus, when the driver turns on the starter switch at the time tc in the conduction-holding period following the period T2, the battery voltage VB decreases as shown in FIG. 6 due to the fact that a current starts flowing to the starter motor. Since the battery voltage VB decreases, the conduction current I flowing through the coil L also decreases, returning the valve body 6a of the electromagnetic valve 6 to the opened-valve position of the non-conduction state. When the battery voltage VB is restored, however, the conduction current I flowing through the coil L will increase again, moving back the valve body 6*a* of the electromagnetic valve 6 at the closed-valve position of the conduction state. This is because the current limit value is fixed at the large first current limit value Ip at the time tc at which the starter switch is turned on. It should be noted that, as described above, the conduction-holding period is a period immediately following the predetermined period T2 and ending at a time the high level driving signal SD is reset to the low level.

The operation to set the current-limit control signal SP at the low level as described is carried out not only when the microcomputer 23 determines that the engine is in a state of being started by detecting the turned-on state of the starter switch, but also when the microcomputer 23 determines that the engine is in a state of being started by detecting the fact that the engine speed Ne is equal to or lower than the second predetermined value N2 serving as a criterion as to whether or not the engine is in a state of being started or when the microcomputer 23 determines that the battery voltage VB is lower than the level-drop criterion voltage VL.

Figure 8:
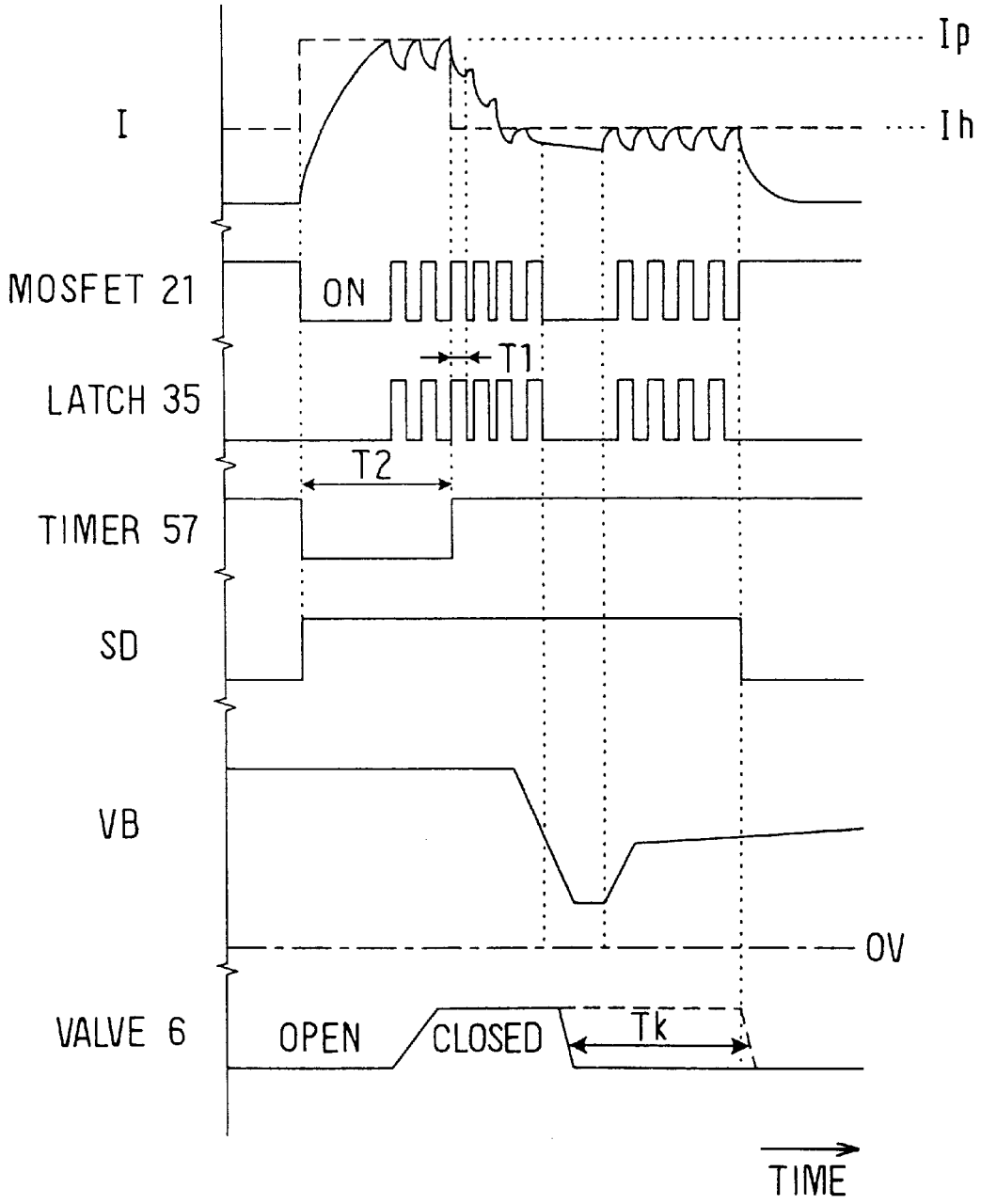
FIG. 8 is a timing diagram showing operations carried out in case a starter condition is not considered.

FIG. 8 shows a case in which no start condition of the engine nor low battery voltage condition is considered, that is, a case in which the current-limit control signal SP and the AND gate 61 are not provided. In this instance, as opposed to the first embodiment, the electromagnetic valve 6 is not closed for a period Tk, if the battery voltage VB drops in the start state of the engine. According to the first embodiment, however, as shown in FIG. 6, such a period Tk can be shortened to a minimum. As a result, it is possible to restrict the amount of fuel supplied to the engine from becoming insufficient at the start time of the engine.

In addition, according to the first embodiment, when the microcomputer 23 determines that the battery voltage VB is lower than the level-drop criterion voltage VL even at a time other than the start time of the engine, the current limit value set by the current-limit-value setting circuit 29 is fixed at the first current limit value Ip. Thus, it is possible to avoid the fact that fuel of a proper amount can no longer be supplied to the engine due to a drop in battery voltage VB.

Furthermore, a drop in battery voltage VB occurring at the start of the engine may not be detected as early as required. According to the first embodiment, however, the fact that the engine is in a state of being started can be determined from the state of the starter switch or the value of the engine speed Ne and, by fixing the current limit value at the first current limit value Ip at a point of time that the engine is in a state of being started is determined. It is thus possible to maintain the desired start characteristic of the engine.

In addition, the microcomputer 23 checks whether the engine speed Ne is equal to or higher than the first predetermined value N1 and, only if the engine speed Ne is determined to be lower than the first predetermined value N1 (NO at step 120), does the microcomputer 23 determine whether the engine is in a state of being started at steps 130 and 170 and whether the battery voltage VB has decreased at step 150. As a result, the processing load borne by the microcomputer 23 can be minimized.

In the first embodiment, the microcomputer 23 may be programmed to carry out only the processing at either step 130, 160 or 170 shown in FIG. 4 in order to determine whether the engine is in a state of being started. In addition, the microcomputer 23 may also carry out only the determination processing at either step 130, step 150 following step 140 or step 170 following step 160 shown in FIG. 4.

In addition, instead of providing the AND gate 61, the microcomputer 23 may be programmed to forcibly keep the timer 57 in a reset state by keeping the current-limit control signal SP at the low level. In this instance, while the current-limit control signal SP output by the microcomputer 23 is being kept at the low level, the timer 57 outputs a low level signal to the base of the NPN transistor 55, holding the NPN transistor 55 in a turned-off state. Thus, the current limit value is fixed at the first current limit value Ip. As a result, it is possible to provide the same effect as the electronic control unit 13 implemented in the first embodiment.

Second Embodiment

Figure 7:
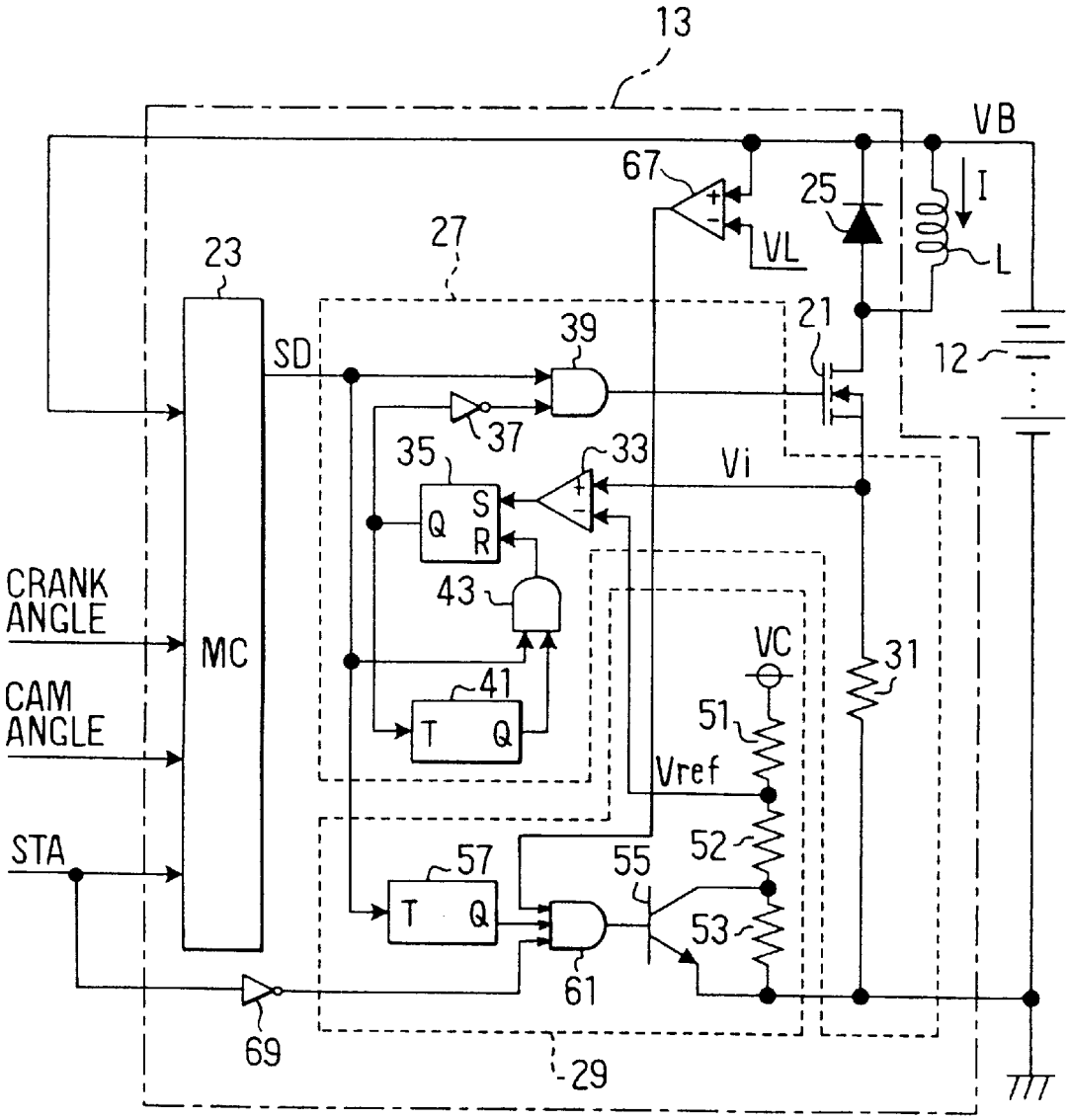
FIG. 7 is a circuit diagram showing an electronic control unit according to a second embodiment of the present invention.

The electronic control unit 13 implemented in a second embodiment is shown in FIG. 7. The second embodiment is differentiated from the first embodiment shown in FIG. 3 as follows.

The microcomputer 23 is programmed not to carry out the processing shown in FIG. 4. Instead, a comparator 67 and an inverter 69 are additionally provided. The comparator 67 compares the battery voltage VB with the level-drop criterion voltage VL and outputs a low level signal if the battery voltage VB is determined to be equal to or lower than the level-drop criterion voltage VL. It outputs a high level signal if the battery voltage VB is determined to be higher than the level-drop criterion voltage VL. The inverter 69 is connected to receive the starter switch signal SW. Further, the AND gate 61 is connected to the output of the comparator 67 and the output of the inverter 69 in addition to the output of the timer 57.

If the battery voltage VB is neither equal to nor lower than the level-drop criterion voltage VL and the starter switch signal SW is set to the low level, the signal output by the timer 57 is passed on through the AND gate 61 to the base of the NPN transistor 55. Thus, the electronic control unit 13 operates in the same manner as in the first embodiment (FIG. 5).

If the battery voltage VB is determined to be equal to or lower than the level-drop criterion voltage VL, putting the signal output by the comparator 67 at the low level, or the starter switch has been turned on, setting the starter switch signal SW at the high level and, hence, holding the signal output by the inverter 69 at the low level, the AND gate 61 supplies the low level signal to the base of the NPN transistor 55 without regard to the signal output by the timer 57. As a result, the NPN transistor 55 is turned off, fixing the reference voltage Vref of the comparator 33 at the reference voltage Vref(Ip) corresponding to the first current limit value Ip as in the first embodiment (FIG. 6).

That is, also in the second embodiment, if the starter switch signal SW indicating that the engine is in the state of being started is detected, or the low level state in which the battery voltage VB is determined to be equal to or lower than the level-drop criterion voltage VL is detected, the current limit value set by the current-limit-value setting circuit 29 is fixed at the first current limit value Ip.

Thus, according to the electronic control unit 13 implemented in the second embodiment, the same effect as the electronic control unit 13 implemented in the first embodiment can be provided without increasing the processing load borne by the microcomputer 23 at all. In the second embodiment, the AND gate 61 may be a two-input type, and either the comparator 67 or the inverter 69 may be eliminated.

Third Embodiment

Figure 9:
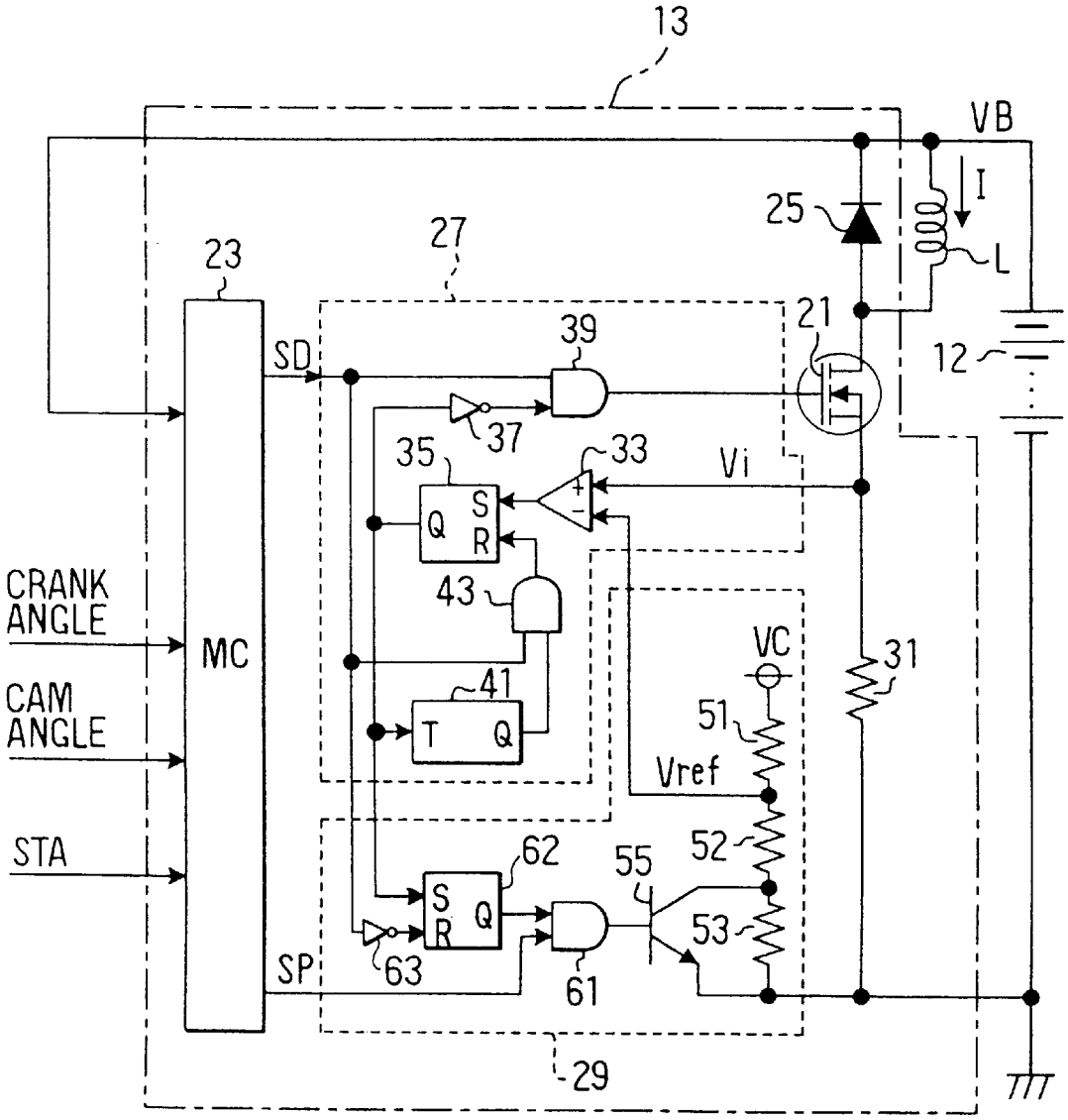
FIG. 9 is a circuit diagram showing an electronic control unit according to a third embodiment of the present invention.

In a third embodiment, the number of turns of the coil L is increased to generate higher magnetomotive force than that in the first and the second embodiments. The increase in the magnetomotive force shortens the period required for the electromagnetic valve 6 to close from its open condition. Therefore, in this embodiment, as shown in FIG. 9, a latch 62 and an inverter 63 are provided in place of the timer 57 of the first embodiment (FIG. 3).

Figure 10:
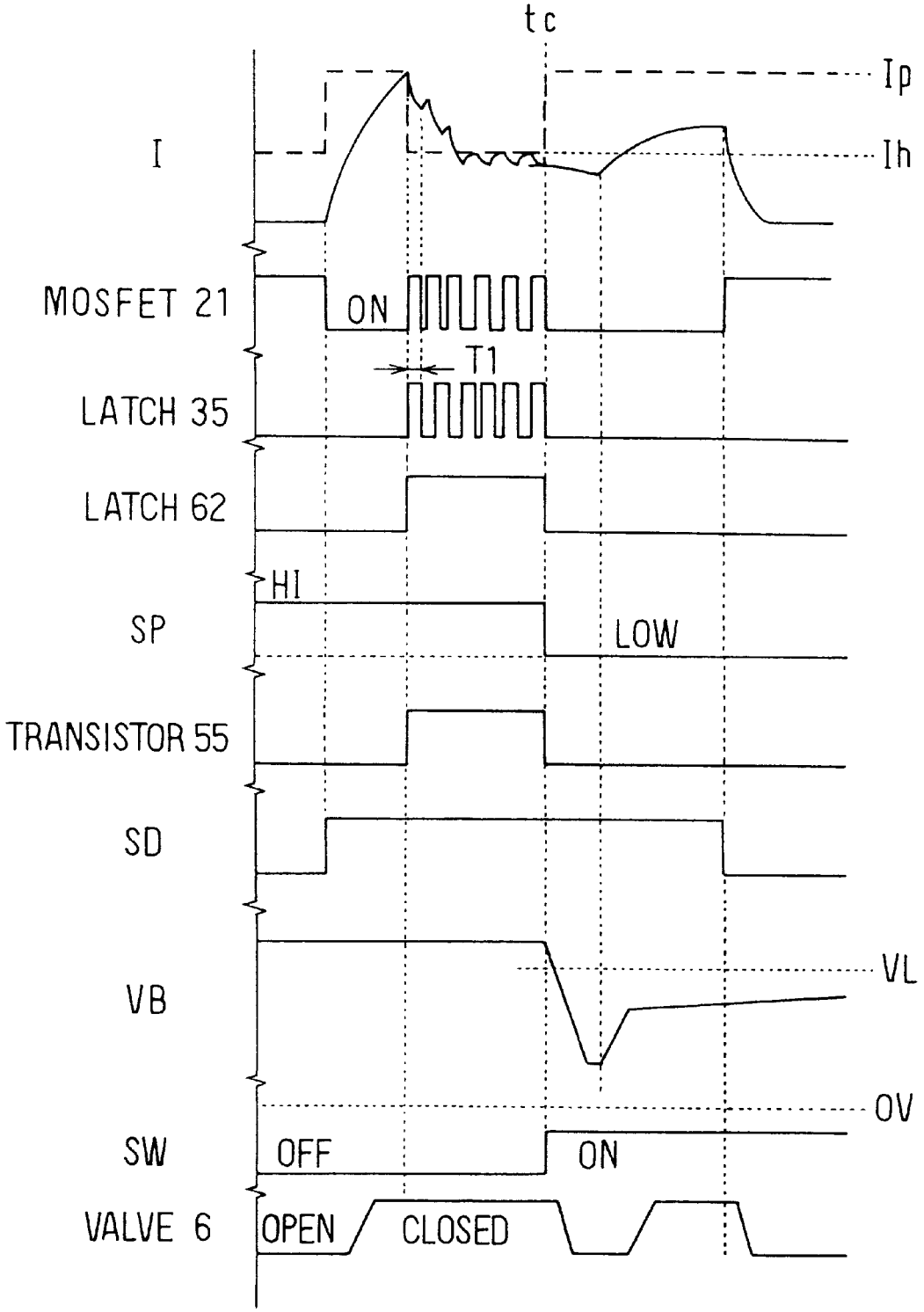
FIG. 10 is a timing diagram showing operations carried out by the electronic control unit of the third embodiment.

As shown in FIG. 10, when the conduction current I in the coil L increases and reaches the first current limit value Ip, the latch 62 produces the high level signal to the AND gate 61 thereby to lower the conduction current I from the first current limit value Ip to the second current limit value Ih. That is, the conduction current I is lowered to the second current limit value Ih immediately after when the conduction current I reaches the first current limit value Ip, without holding the conduction current I at the first current limit value Ip for the period T2 as implemented in the first and the second embodiments.

Fourth Embodiment

Figure 11:
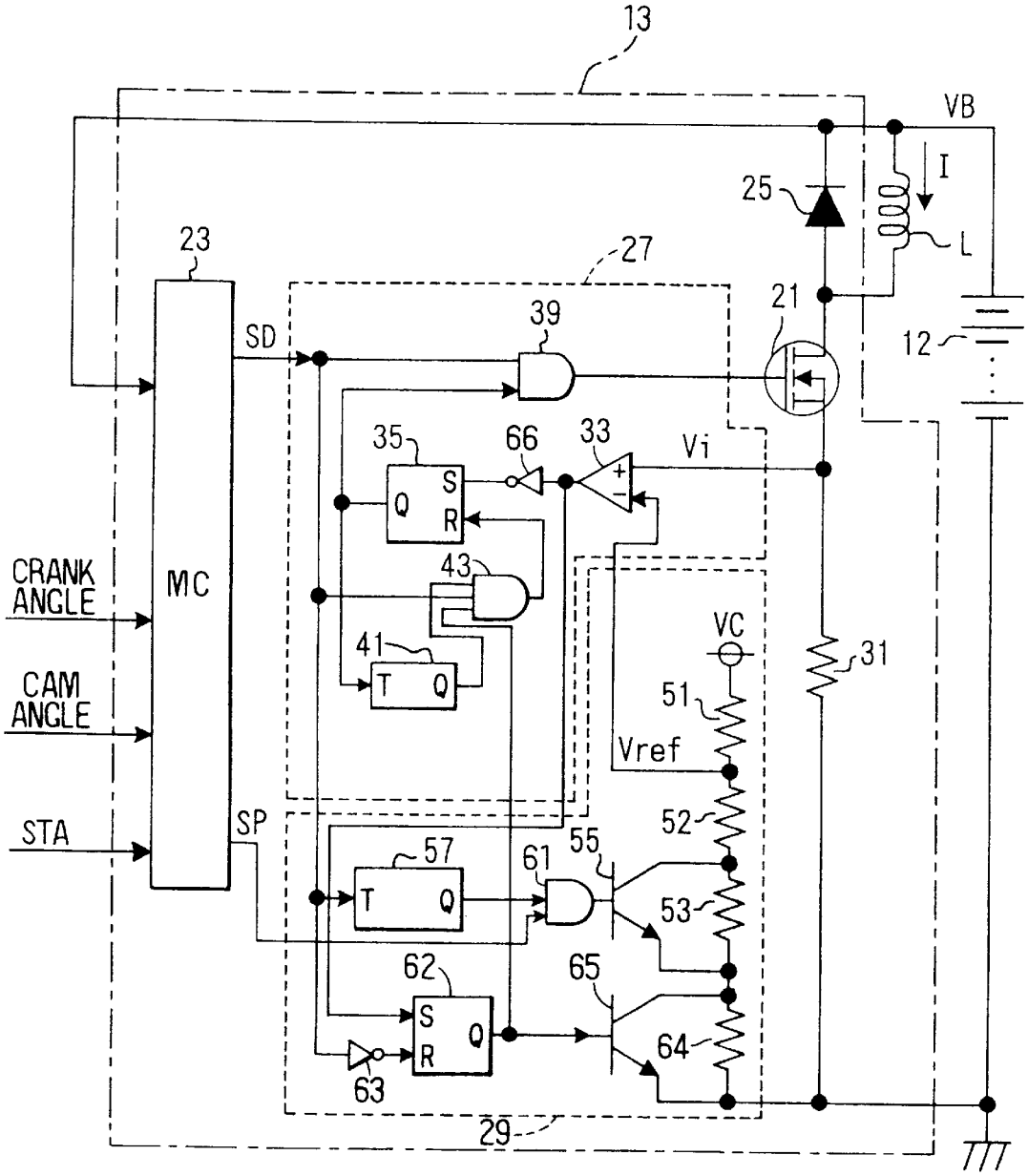
FIG. 11 is a circuit diagram showing an electronic control unit according to a fourth embodiment of the present invention.
Figure 12:
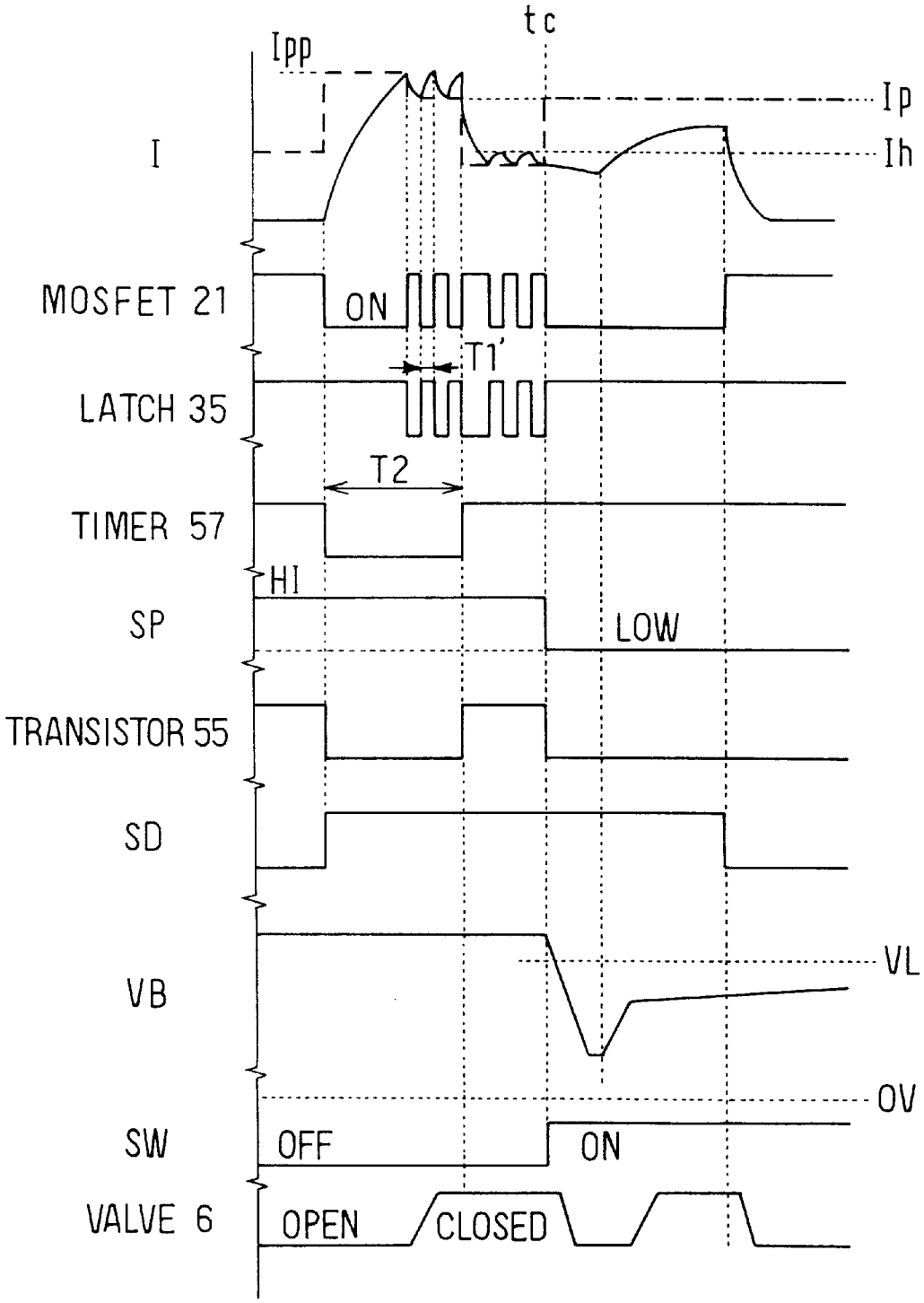
FIG. 12 is a timing diagram showing operations carried out by the electronic control unit of the fourth embodiment.

In a fourth embodiment, the electronic control unit 13 is constructed as shown in FIG. 11 to control the conduction current I by fixing an on-time T1' of the MOSFET 21 as shown in FIG. 12 as opposed to the first to the third embodiment.

In this embodiment, during the period T2, the MOSFET 21 is initially turned on until the conduction current I increases and reaches an initial current limit value Ipp set higher than the first current limit value Ipp. The MOSFET 21 is turned off until the conduction current I decreases to the first current limit value Ip. Thereafter, the MOSFET 21 is turned on for a fixed time T1' each time the conduction current I decreased to the first current limit value Ip. That is, the current limit value is changed from Ipp to Ip because a SR latch 62 outputs a high level signal and a transistor 65 is turned on to short-circuit a resistor 63 when the conduction current I increases above the current limit value Ipp for the first time. The timer 41 counts the on-time T1'.

After the time period T2, the MOSFET 21 is turned on for the fixed time T1' each time the conduction current decreases to the second current limit value Ih, because the output of the timer 57 changes to the high level after the period T2 and the AND gate 61 produces the high level signal to turn on the transistor 55, thus changing the current limit value from the first current limit value Ip to the second current limit value Ih.

The present invention should not be limited to the disclosed embodiments but may be implemented in many other ways.

For example, the electromagnetic valve can be a fuel injection valve (injector) of the electromagnetic type for supplying fuel to an engine or a spill control valve of the electromagnetic type employed in a fuel injection pump of a diesel engine. In addition, the reference voltage Vref supplied to the inverting input terminal of the comparator 33 may be changed from the reference voltage Vref(Ih) corresponding to the second current limit value Ih to a voltage Vref (I3) corresponding to a third current limit value I3 which is greater than the second current limit value Ih during the conduction-holding period.

What is claimed is:

1. A driving apparatus for an electromagnetic valve having a coil for supplying fuel to an engine of a vehicle comprising:

a switching device provided in series with the coil for supplying a conduction current from a battery to the coil to drive the electromagnetic valve when turned on;

driving signal outputting means for outputting a driving signal for turning on the switching device in response to the rotation of the engine;

conduction control means for turning on the switching device so as to set the conduction current at a predetermined current limit value while the driving signal outputting means is outputting the driving signal; and current-limit-value setting means for setting the predetermined current limit value of the conduction control means at a first current limit value starting at a point of time the driving signal is output by the driving signal outputting means till a predetermined condition is satisfied, and setting the predetermined current limit value of the conduction control means at a second current limit value smaller than the first current limit value after the predetermined condition gets satisfied until the driving signal is no longer output, wherein current-limit-value changing means is provided to change the second current limit value set by the current-limit-value setting means to a third current limit value larger than the second current limit value, when the engine is in the state of being started.

2. The driving apparatus according to claim 1, wherein the third current limit value is equal to the first current limit value.

3. The driving apparatus according to claim 2, wherein the current-limit-value changing means includes:

a microcomputer for repeatedly determining whether the engine is in the state of being started, and for outputting a signal indicating that the engine is in the state of being started if the engine is in the state of being started; and fixing means for fixing the second current limit value set by the current-limit-value setting means at the first current limit value while the microcomputer is outputting the signal indicating that the engine is in the state of being started.

4. The driving apparatus according to claim 3, wherein the microcomputer checks whether the engine is in the state of being started by determining at least one of whether an engine speed is less than a predetermined value smaller than an idling rotational speed and whether a starter switch for starting the engine has been turned on.

5. The driving apparatus according to claim 3, wherein the microcomputer checks whether an engine speed is higher than a predetermined value greater than the idling rotational speed, and checks whether the engine is in the state of being started only if the engine speed is determined to be lower than the predetermined value greater than the idling rotational speed.

6. The driving apparatus according to claim 2, wherein the current-limit-value changing means fixes the second current limit value at the first current limit value while a signal is being output to indicate that a starter switch for starting the engine has been turned on.

7. The driving apparatus according to claim 1, wherein the current-limit-value setting means changes the current limit value from the first current limit value to the second current limit value immediately after the conduction current reaches the first current limit value.

8. The driving apparatus according to claim 1, wherein:

the switching device is turned on at a time of start of the conduction period until the conduction current reaches a predetermined initial current limit value set to be larger than the second current limit value; and the switching device is turned on for a fixed on-time each time the conduction current decreases to the first current limit value after reaching the initial current limit value.

9. A driving apparatus for an electromagnetic valve having a coil for supplying fuel to an engine of a vehicle comprising:

a switching device provided in series with the coil for supplying a conduction current from a battery to the coil to drive the electromagnetic valve when turned on;

driving signal outputting means for outputting a driving signal for turning on the switching device in response to the rotation of the engine;

conduction control means for turning on the switching device so as to set the conduction current at a predetermined current limit value while the driving signal outputting means is outputting the driving signal; and current-limit-value setting means for setting the predetermined current limit value of the conduction control means at a first current limit value starting at a point of time the driving signal is output by the driving signal outputting means till a predetermined condition is satisfied, and setting the predetermined current limit value of the conduction control means at a second current limit value smaller than the first current limit value after the predetermined condition gets satisfied until the driving signal is no longer output, wherein current-limit-value changing means is provided to change the second current limit value set by the current-limit-value setting means to a third current limit value larger than the second current limit value, when a voltage of the battery is decreased to be lower than a predetermined voltage.

10. The driving apparatus according to claim 9, wherein the third current limit value is equal to the first current limit value.

11. The driving apparatus according to claim 10, wherein the current-limit-value changing means includes:

a microcomputer for repeatedly determining whether the voltage of the battery is lower than the predetermined voltage, and for outputting a signal indicating a low voltage condition of the battery; and fixing means for fixing the second current limit value set by the current-limit-value setting means at the first current limit value while the microcomputer is outputting the signal.

12. The driving apparatus according to claim 11, wherein the microcomputer checks whether an engine speed is higher than a predetermined value greater than the idling rotational speed, and checks whether the voltage of the battery is in the low voltage condition only if the engine speed is determined to be lower than the predetermined value greater than the idling rotational speed.

13. The driving apparatus according to claim 10, wherein the current-limit-value changing means includes a comparator for comparing the voltage of the battery with the predetermined voltage, and fixes the second current limit value at the first current limit value while the comparator is outputting the signal indicative of a low voltage condition of the battery.

14. A driving apparatus for an electromagnetic valve having a coil for supplying fuel to an engine of a vehicle comprising:

a switching device provided in series with the coil for supplying a conduction current from a battery to the coil to drive the electromagnetic valve when turned on;

driving signal outputting means for outputting a driving signal for turning on the switching device in response to the rotation of the engine;

conduction control means for turning on the switching device so as to set the conduction current at a predetermined current limit value while the driving signal outputting means is outputting the driving signal; and current-limit-value setting means for setting the predetermined current limit value of the conduction control means at a first current limit value starting at a point of time the driving signal is output by the driving signal outputting means till a predetermined condition is satisfied, and setting the predetermined current limit value of the conduction control means at a second current limit value smaller than the first current limit value after the predetermined condition gets satisfied until the driving signal is no longer output, wherein current-limit-value changing means is provided to change the second current limit value set by the current-limit-value setting means to a third current limit value larger than the second current limit value, when a parameter indicative of at least one of the engine is in the state of being started and a voltage of the battery is lower than a predetermined voltage is detected.

15. The driving apparatus according to claim 14, wherein the third current limit value is equal to the first current limit value.

16. The driving apparatus according to claim 15, wherein the current-limit-value changing means comprises:

a microcomputer for repeatedly determining whether the engine is in the state of being started and whether the voltage of the battery is in a low voltage condition, and for outputting a signal indicating that the engine is in the state of being started if the engine is in the state of being started or that the voltage of the battery is in the low voltage condition; and fixing means for fixing the second current limit value at the first current limit value while the microcomputer is outputting the signal.

17. The driving apparatus according to claim 16, wherein the microcomputer checks whether the engine is in the state of being started by determining either whether an engine speed is lower than a predetermined value smaller than an idling rotational speed or whether a starter switch for starting the engine has been turned on.

18. The driving apparatus according to claim 16, wherein the microcomputer checks whether an engine speed is higher than a predetermined value greater than an idling rotational speed, and checks whether the engine is in the state of being started only if the engine speed is determined to be lower than the predetermined value greater than the idling rotational speed.

19. The driving apparatus according to claim 15, wherein the current-limit-value changing means includes a comparator for comparing the voltage of the battery with the predetermined voltage, and fixes the third current limit value at the first current limit value in response to the parameter indicative of a low voltage condition of the battery or a starting condition of the engine.

20. The driving apparatus according to claim 14, wherein the electromagnetic valve is mounted on a high-pressure pump for adjusting a pressure of fuel supplied to the engine.

21. The driving apparatus according to claim 14, wherein the electromagnetic valve is mounted on the engine as a fuel injection valve for injecting fuel therefrom.

* * * * *